US005868012A

United States Patent [19]

Chun-Te et al.

[11] Patent Number: 5,868,012

[45] Date of Patent: Feb. 9, 1999

[54] CHAIN LOCK

[76] Inventors: Yu Chun-Te, P.O. Box 55-175, Taichung, Taiwan; Stephen M. Scott, 338 Carrera Dr., Mill Valley, Calif. 94941

[21] Appl. No.: 958,617

[22] Filed: Oct. 27, 1997

[51] Int. Cl.[6] ..... E05B 37/14

[52] U.S. Cl. ..... 70/30; 70/312

[58] Field of Search ..... 70/18, 30, 53, 70/58, 312

[56] References Cited

U.S. PATENT DOCUMENTS

| | | | |
|---|---|---|---|
| 616,647 | 12/1898 | Woodward | 70/30 |
| 1,240,146 | 9/1917 | Jackson | 70/30 |
| 3,670,535 | 6/1972 | Stettner et al. | 70/312 X |
| 4,198,837 | 4/1980 | Gisiger | 70/312 X |
| 4,610,152 | 9/1986 | Düringer | 70/312 X |
| 4,621,509 | 11/1986 | Mizuno | 70/312 X |
| 4,896,517 | 1/1990 | Ling | 70/18 |
| 5,142,888 | 9/1992 | Ling | 70/312 X |
| 5,156,028 | 10/1992 | Jiang | 70/18 X |
| 5,367,785 | 11/1994 | Benarroch | 70/30 X |
| 5,560,232 | 10/1996 | Chen | 70/30 |

FOREIGN PATENT DOCUMENTS

| | | | |
|---|---|---|---|
| 2030208 | 4/1980 | United Kingdom | 70/312 |

*Primary Examiner*—Lloyd A. Gall
*Attorney, Agent, or Firm*—Harrison & Egbert

[57] ABSTRACT

A chain lock for locking the wheel of a motorcycle or bicycle and a series of travelling certificates is provided. The chain lock includes a locking body having a combination locking device and a novel locking mechanism disposed therein, a chain or a flexible wire having at a first end an obturator embedded into the locking body and controlling the activity of the locking mechanism in cooperation with the combination locking device and a plug at a second end of the chain which is lockable by a latch and ejectable from the locking body by an ejector when the plug is unlockable. The obturator is operated as a hiding key for enhancing the anti-burglar effect of the chain lock.

4 Claims, 7 Drawing Sheets

CHAIN LOCK

TECHNICAL FIELD

The present invention relates to locks and more particularly to an improved chain lock which includes a novel unlocking device as to enhance the anti-burglar effect.

BACKGROUND ART

Typical chain locks include generally a locking body and a chain or flexible wire which has one end connected with one side of the locking body and the other end has a plug lockable into a recessed latch in the other side of the body. The locking body may be an ordinary keyed lock, a safety lock or a combination lock. No matter whatever they are, they have the sane unlocking manner. When the lock is turned into an opening position, the plug of the chain will be ejected out of the locking body and therefore unlocked. This manner is well known and are not very burglarproof. However, the chain lock is useful nowadays. It not only locks a wheel of a motorcycle or a bicycle, a number of keys, but also a series of travelling certificates such as a passport, an air ticket, a boarding pass etc., so that an exquisite, reliable and portable chain lock is required.

SUMMARY OF THE PRESENT INVENTION

The present invention has a main object to provide a chain lock which has a novel specific unlocking manner so as to enhance the anti-burglar effect.

Another object of the present invention is to provide a chain lock which includes a slidable obturator at a fixed end of the chain and operated in cooperation with a combination lock device in the locking body so as to control the locking or unlocking of a plug at the other end of the chain.

Still another object of the present invention is to provide a chain lock which is capable of locking up a series of travelling certificates.

The present invention will become more fully understood by reference to the following detailed description thereof when read in conjunction with the attached drawings.

DETAILED DESCRIPTION OF THE PREFERRED EMBODIMENT

Figure 1:
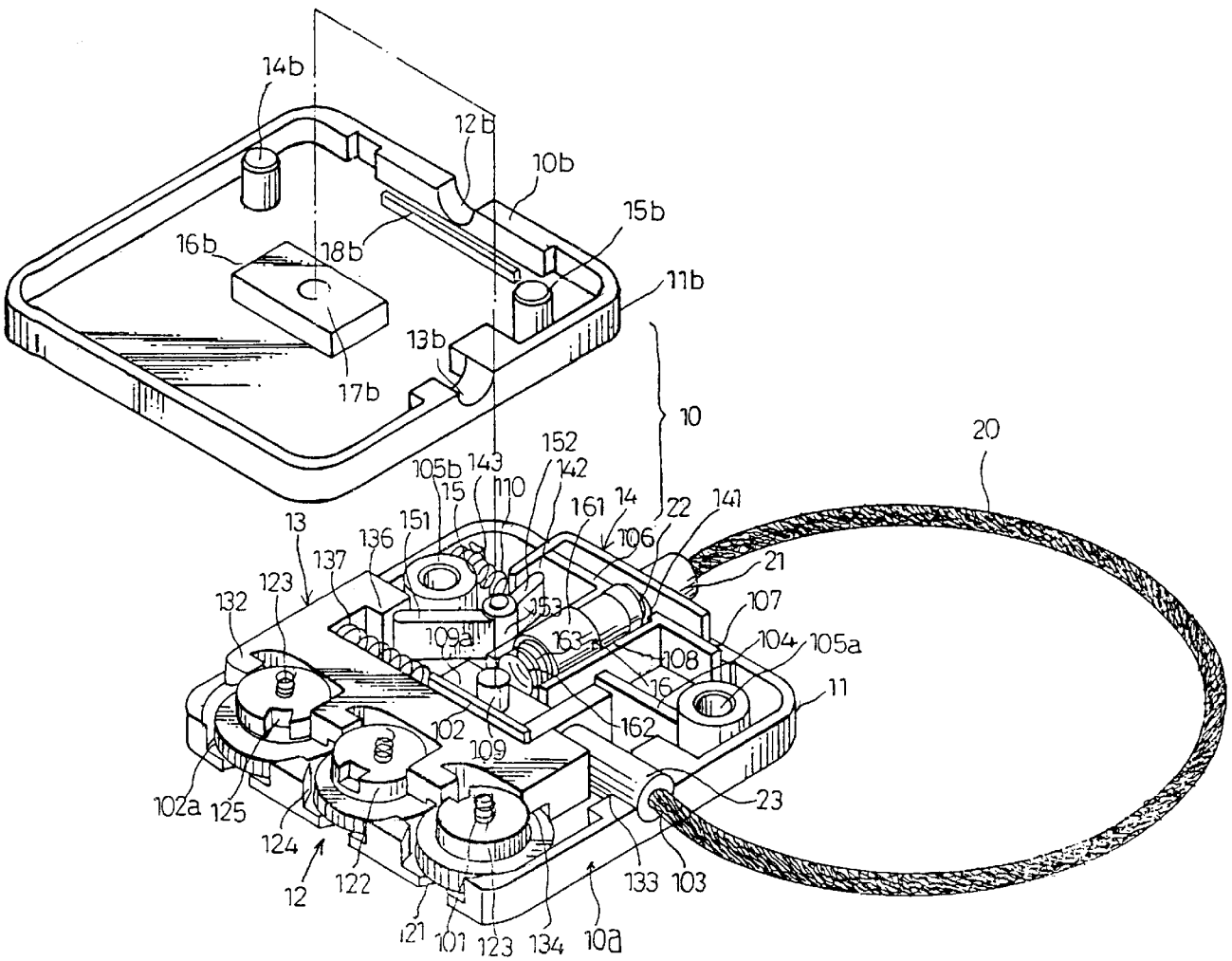
FIG. 1 is an exploded perspective view to show the preferred embodiment of the present invention.
Figure 2:
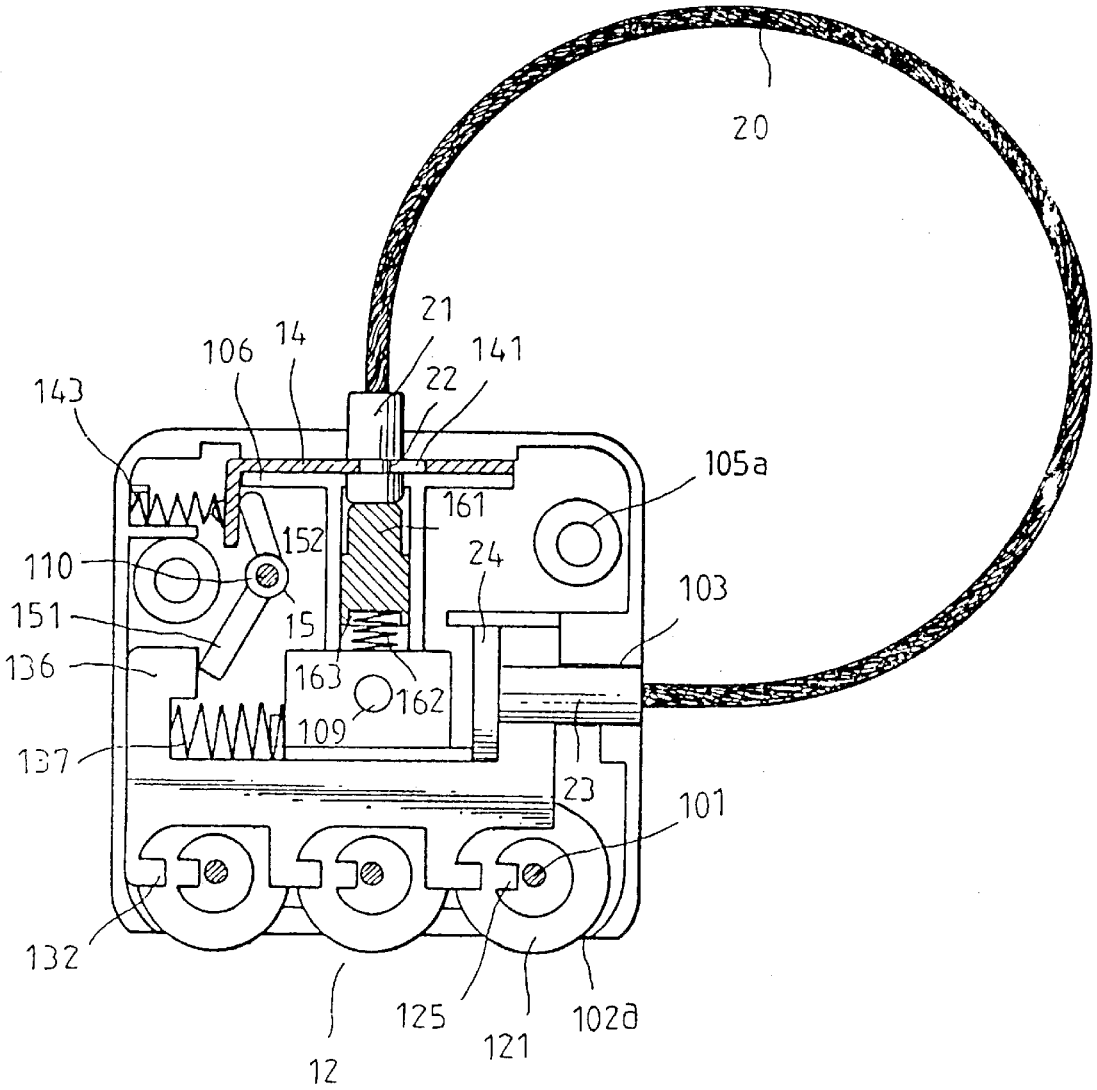
FIG. 2 is a plan view to show the chain being locked up while the dial are at a combination position.

With reference to FIGS. 1 and 2, the chain lock of the present invention comprises generally a locking body 10 and a chain or flexible wire 20. The locking body 10 includes a rectangular casing 1*a* and a lid 10*b* engageable with the casing 10*a* and includes four side walls 11, three accesses 102*a* formed spaced apart along a rear side wall, a first and a second semi-circular recess 103 centrally formed in a forward side wall and right side wall respectively, three first pivots 101 projected spaced apart from an inner surface of the bottom adjacent the accesses 102*a* for rotatably engaging with a combination locking device 12 which includes three conventional dials 121 each integral with a small diameter engaging piece 124 each of which has a notch 125 in a circumference, a first extension 102 transversely extended along an appropriate central portion of the inner surface, a second extension 104 transversely extended on the inner surface from an appropriate center and terminated at an inward periphery of a first coupling pole 105*a* which is projected upward from a inner surface abutting the right side wall wherein a second coupling pole 105*b* projects upward abutting an opposite left side wall and symmetrical to the first coupling pole 105*a,* a pair of L-shaped third extensions 106 centrally projected spaced apart adjacent the fore portion of the casing 10*a* so as to define a longitudinal chamber 108 therebetween and a sliding space 107 between the front wall of the casing 10*a* and themselves, a coupling rod 109 centrally projected upward from an upper surface of a rectangular abutment 109*a* which is positioned between the forward surface of the first extension 102 and the rearward ends of the pair of L-shaped third extensions 106, a second pivot 110 projected upward from an inner surface between the second coupling pole 105*b* and one of the third extensions 106, a roughly T-shaped slide 13 slidably engaged in a rear portion of the casing la between the first extension 102 and the combination locking device 12, a roughly V-shaped lever 15 rotatably engaged on the second pivot 110, an L-shaped latch 14 slidably engaged in the sliding space 107 and an ejector means 16 slidably engaged into the longitudinal chamber 108. The slide 13 includes three L-shaped protrusions 132 extended spaced apart from a rear edge engageable with the notches 125 of the combination locking device 12, an elongate slot 134 formed along the under side of the rear edge slidably engageable with an inward portion of the dials 121, a transverse extension 133 extended forward from a right side end and an L-shaped actuator 136 extended forward from a left side end relative to the casing 10*a*. When the slide 13 is engaged in place into the rear portion of the casing 10*a,* a first spring means 137 is adapted to bias against the L-shaped actuator 136 and the left end of the first extension 102 so that the slide 13 is normally positioned at a left side of the casing la and disengageable with the notches 125 of the combination locking device 12. The L-shaped latch 14 includes a catch hole 141 centrally formed in a transverse portion which is slidable in the sliding space 107 and a longitudinal portion 142 biased by a second spring means 143 which is biased between a confined inner surface of the left side wall of the casing la and the outward surface of the longitudinal portion 142 so that the latch 14 normally tend toward the right side of the casing la. The lever 15 includes an axial hollow cylinder 153 rotatably wrapped onto the second pivot 110, a first end 152 slantedly extended from a forward peripheral wall of the cylinder 153 and stopped against an inner surface of the longitudinal portion 142 of the latch 14 and a second end 151 slantedly extended from a rear peripheral wall of the cylinder 153 and stopped against an inward end of the L-shaped actuator 136. The ejector means 16 includes a metallic stepped cylinder body 161 slidably engaged into the longitudinal chamber 108 of the casing la having a small diameter forward end engageable into the catch hole 141 of the latch 14 and a central cavity 163 in a rearward end engageable within one end of a third spring means 162 which has another end stopped against the forward surface of the abutment 109*a* so that the cylinder 161 tends toward the forward side normally relative to the casing 10*a*. The lid 10*b* includes four side walls 11*b* engageable with the side walls 11, a pair of third and fourth semi-circular recesses 12*b* and 13*b* respectively engageable with the first and second semi-circular recesses 103 so as to form a pair of circular recesses therebetween, a pair of coupling rods 14*b* and 15*b* engageable with the coupling poles 105*a* and 105*b*, a rectangular projection 16*b* including a central bore 17*b* respectively engageable with the coupling rod 109 and the abutment 109*a*, and a small fourth extension 18*b* transversely extended along a forward central portion of the inner surface and engageable with the tops of the transverse portions of the L-shaped third extensions 106.

The chain 20 or flexible wire includes a plug 21 at a first end engageable into the circular recess in front side of the body 10, an annular groove 22 formed around an outer periphery engageable with the catch hole 141 of the latch 14, an obturator 23 at a second end of the chain 20 slidably engaged into the circular recess in a right side of the body 10 and a rectangular pushing plate 24 perpendicularly connected to the inward end of the obturator 23 and engageable with an inner side of the transverse extension 133 of the slide 13, so that the obturator 23 is normally retained by the extension 133 and remains inside the body 10.

Figure 7:
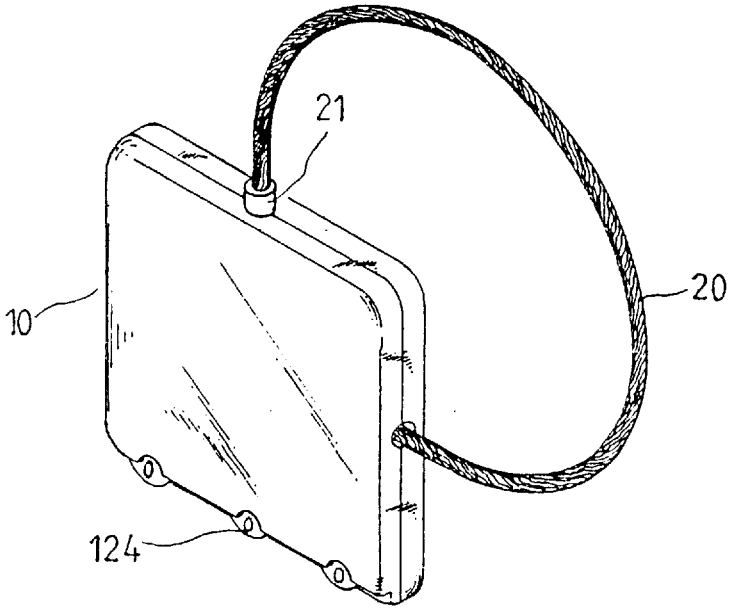
FIG. 7 is a perspective view to show the arrangement of the chain lock while the plug is locked up in the body.

Further, before the lid 10*b* mounts to the casing 10*a* in a snap setting, three fourth spring means 123 are biased on the top of the first pivots 101 and the dials 121 are operable from the accesses 102*a*. FIG. 7 shows an assembled chain lock of the present invention in which the plug 21 is locked up and the combination locking device 12 is in combination (as shown in FIG. 2).

Figure 3:
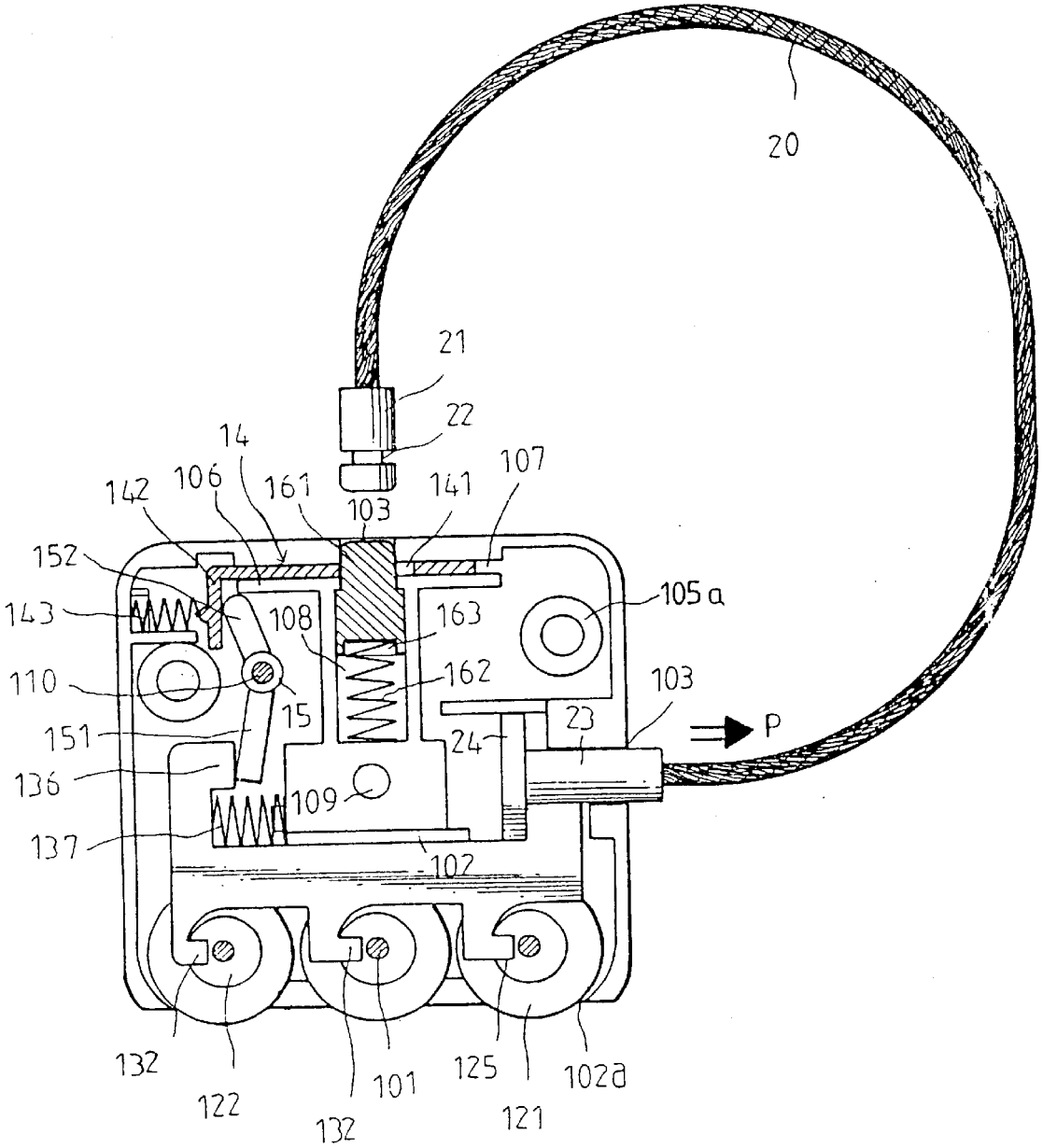
FIG. 3 is a plane view to show the plug of the chain being ejected out of the locking body while the obturator is drawn outward.
Figure 4:
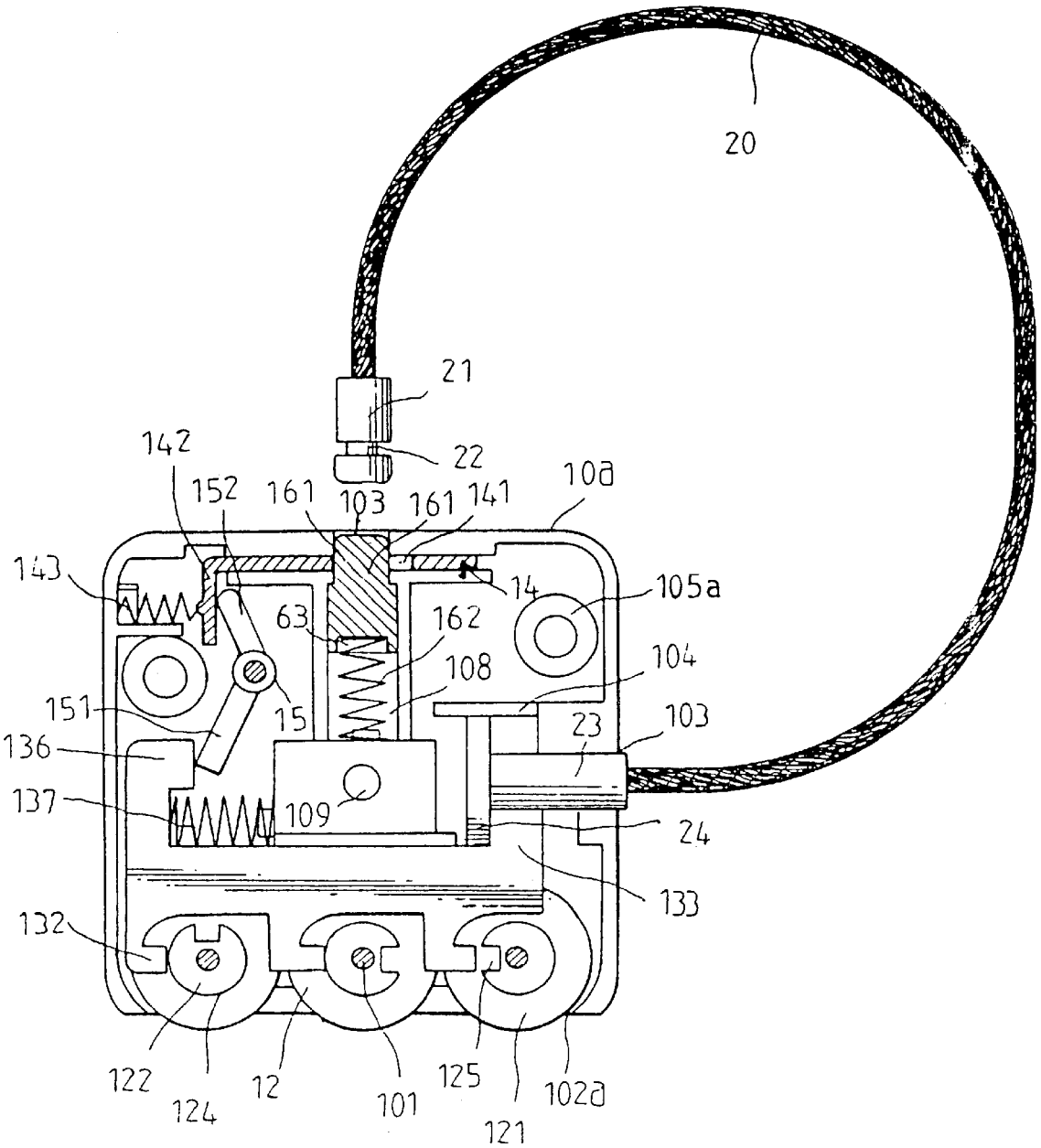
FIG. 4 is a plan view to show the plug of the chain being lockable while the dials are disordered.
Figure 5:
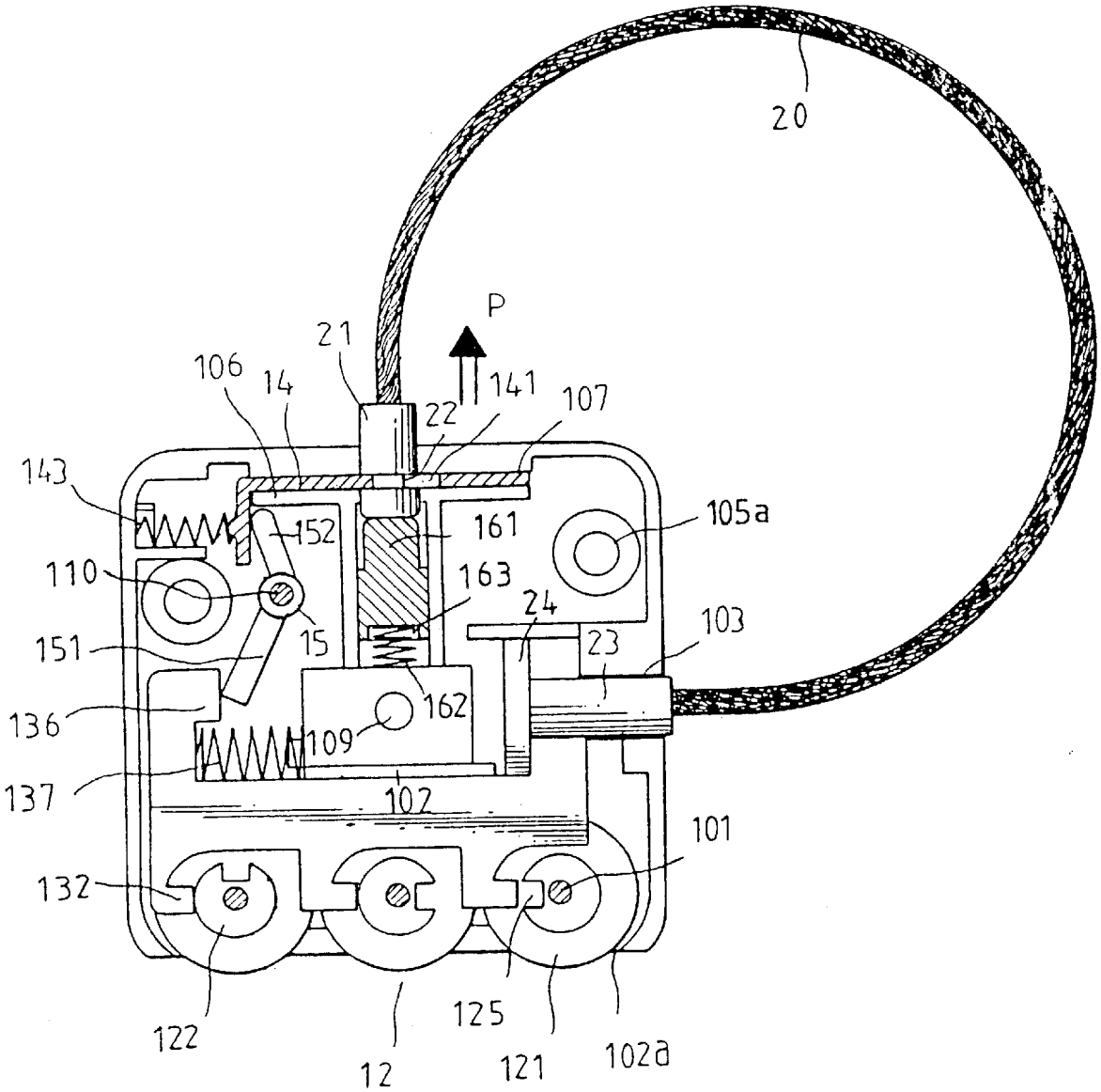
FIG. 5 is a plan view to show the plug of the chain being locked up while the dials are still in a disordered condition, FIGS. 6 and 6A indicate the relationship between the plug and the latch.
Figure 6:
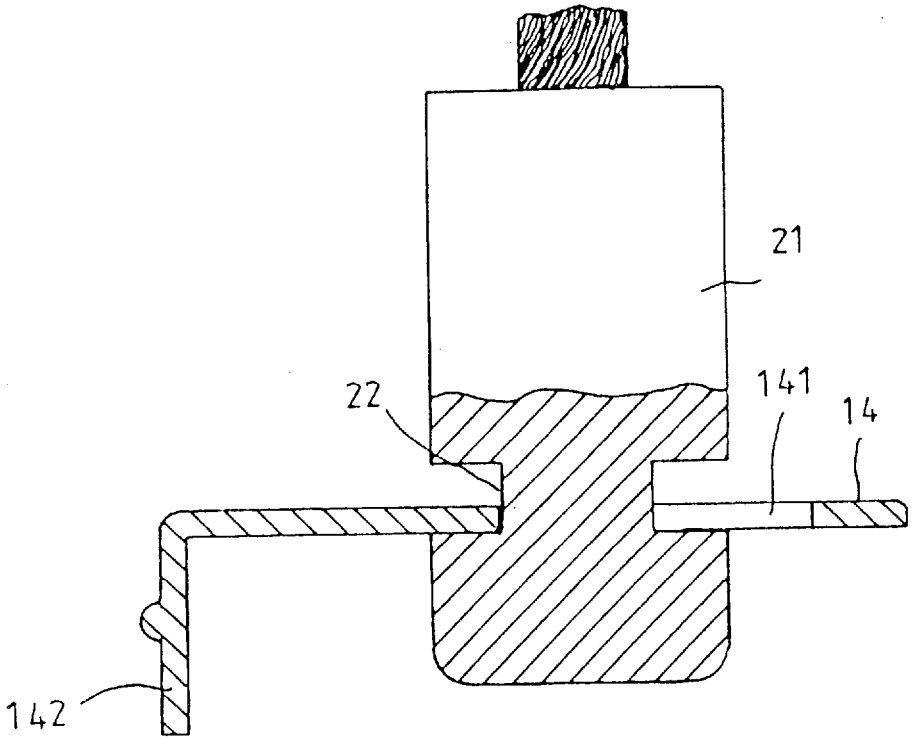
Figure 6A:
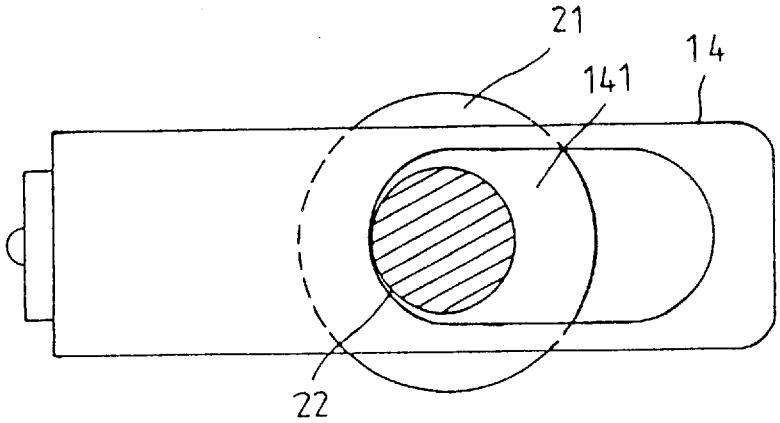

Referring to FIGS. 3–6A of the drawings and again FIG. 2 which illustrate the operation of the present invention. FIG. 2 shows that the combination locking device 12 is now in combination as the notches 125 of the dials 121 are in alignment and ready for the L-shaped protrusions 132 to be engaged therewithin in order to unlock the plug 21 from the catch hole 141. However, the slide 13 is biased by the spring means 137 and tends toward the left side relative to the casing la. If the user does not know to pull the obturator 23 of the chain 20 outward to let its pushing plate 24 actuating the slide 13 to Rove rightward, the chain lock will never be unlocked. This is a novel and specific structural improvement of the present invention which may be namely a hiding key to prevent a stranger or a burglar from opening the lock. FIG. 3 shows that the obturator 23 is pulled out to draw the slide 13 to the right so as to permit the protrusions 132 to engag into the notches 125. Meanwhile, the lever 15 is pushed by the L-shaped actuator 136 to rotate counterclockwise and its first end 152 in turn to forces the L-shaped latch 14 to move leftward so as to disengage the catch hole 141 with the annular groove 22 of the plug 21 and to permit the small forward end of the metallic stepped cylinder 161 of the ejector means 16 to dash upward into the catch hole 141 under a resilient force to eject the plug 21 of the chain 20 out of the locking body 10. FIG. 4 shows that when the obturator 23 is released, it is immediately pulled back into the body 10 by the slide 13 under the resilient force of the first spring means 137. This time, the L-shaped protrusions 132 are disengaged from with the notches 125 so as to permit the dials 121 to be rotatable again. Nevertheless, the L-shaped latch 14 can not slide rightward because its catch hole 141 is obstructed by the metallic stepped cylinder 161 of the ejector means 16. This may be namely a ready to lock state. FIG. 5 shows that the combination locking device 12 is disordered from a combination state, so as to constrain the obturator 23 from drawing out of the locking body 10. However, the plug 21 is insertable into the catch hole 141 via the forward recess of the body 10 and forces the stepped cylinder 161 of the ejector means 16 to move backward so as to permit its annular groove 22 to be retained by the catch hole 141 as shown in FIGS. 6 and 6A and its inward end is conducted toward to the forward end of the stepped cylinder 161.

It is understood that the plug 21 could not be drawn out of the locking body 10 except making the dials 121 of the combination locking device 12 into combination and drawing obturator 23 outward again and repeating the opening process as recited the hereinabove.

According to the aforediscussions, the chain lock of the present invention provides a novel physical structure and provide unexpected results which greatly enhance the anti-burglar effect as well as the broader applications.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A chain lock comprising:

a rectangular locking body composed of a casing and a lid engageable with the casing;

said casing comprising a rectangular base having side walls projected upward from four sides which are defined as a front side, a rear side, a left side and a right side of the casing, a first and second semi-circular recess centrally formed in the front side wall and the right side wall respectively, a plurality of accesses formed spaced apart in the rear side wall, a plurality of pivots spaced apart and projected from an inner surface of the base adjacent the accesses for pivoting thereon a plurality of dials of a combination locking device each of which includes a small diameter engaging piece having a notch in a circumference and biasing by a spring means, a first extension transversely extending along a central portion of the inner surface of the base, a second extension transversely extending from an appropriate center of the inner surface near the front side wall and terminated at an inward periphery of a first coupling pole, said first coupling pole is projected upward from an inner surface of the base abutting the right side wall, a second coupling pole projected upward from a position abutting the left side wall, a pair of L-shaped third extensions, parallel and symmetrically extending along a central fore portion of the inner surface of the base adjacent the front side wall so as to define a longitudinal chamber therebetween and a sliding space between the front side wall and themselves, a rectangular abutment positioned at a central portion of the base between the first extension and the pair of third extensions including a coupling rod centrally projected upward from an upper surface thereof, a second pivot projected upward from an inner surface of the base between the second coupling pole and one of the third extensions, a roughly T-shaped slide slidably disposed in a rear portion of the casing between the first extension and the combination locking device including a plurality of L-shaped protrusions extending spaced apart from a rear edge relative to the casing and engageable with the notches of the plurality of small diameter engaging pieces, an elongate slot formed along an underside of the rear edge engageable partially with an inward portion of the dials which are partially exposed out of the accesses, a transverse extension perpendicularly extending forward from a rightward end relative to the casing and an L-shaped actuator extending forward from a leftward end relative to the casing, an L-shaped latch means including a transverse portion slidably engaged into the sliding space of the casing having a catch hole centrally formed in said transverse portion and a longitudinal portion biased by a second spring means which is transversely disposed between said longitudinal portion and an inner side of the left side wall, a lever means including an axial tubular member rotatably wrapped on the second pivot, a first end slantly extending from a forward periphery of the tubular member and stopped against an inner side of the longitudinal portion of said latch means and a second end slantly extending from a rearward periphery of the tubular member and stopped against an inner end of the actuator of said slide, an ejector means including a metallic stepped cylinder body slidably disposed into the longitudinal chamber of the casing having a small diameter forward end engageable into the catch hole of said latch means and a recessed rearward end engageable with one end of a third spring means which has another end biased against a forward side of the rectangular abutment;

said lid comprising a rectangular base, four side walls engageable with the side walls of the casing, a third and a fourth semi-circular recess respectively engageable with the first and second semi-circular recesses of the casing, a pair of coupling rods engageable with the first and second coupling poles of the casing, a rectangular projection at a center of the base including a central bore respectively engageable with the abutment and the coupling rod of the casing and a fourth extension transversely extending along a fore central portion of the base engageable with an upper surface of the transverse portions of the pair of L-shaped extensions;

a chain means including a chain having an obturator integrated with a first end and slidably retained into the second recess of the casing and a plug integrated with a second end insertable into the first recess and lockable into the catch hole of the latch means;

whereby said obturator controls the unlocking activity of said body while said combination locking device is in combination and said plug is lockable into the catch hole of the latch means, and ejected by the ejector means out of said body when the catch hole is disengaged with an annular groove of said plug.

2. A chain lock as recited in claim 1 wherein said plug includes a cylinder body integrated with a second end of the chain having an annular groove around a periphery thereof lockable within the catch hole of the latch means.

3. A chain lock as recited in claim 1 wherein said obturator includes a cylinder body slidably engageable into the circular recess in the right side wall of the locking body and a rectangular pushing plate perpendicular to the forward end of the cylinder body engageable with an inner side of the transverse extension of said slide.

4. A chain lock as recited in claim 1 wherein said chain is a flexible wire.

* * * * *